US010182697B2

(12) United States Patent
Schultheis et al.

(10) Patent No.: US 10,182,697 B2
(45) Date of Patent: Jan. 22, 2019

(54) UPWARD SPRAYING FLOOR CLEANING APPARATUS

(71) Applicants: Thomas Kenneth Schultheis, Santa Barbara, CA (US); Thomas Carey Schultheis, Santa Barbara, CA (US)

(72) Inventors: Thomas Kenneth Schultheis, Santa Barbara, CA (US); Thomas Carey Schultheis, Santa Barbara, CA (US)

( * ) Notice: Subject to any disclaimer, the term of this patent is extended or adjusted under 35 U.S.C. 154(b) by 0 days.

(21) Appl. No.: 14/925,140

(22) Filed: Oct. 28, 2015

(65) Prior Publication Data

US 2016/0120389 A1 May 5, 2016

Related U.S. Application Data

(60) Provisional application No. 62/072,539, filed on Oct. 30, 2014.

(30) Foreign Application Priority Data

Nov. 21, 2014 (GB) ..... 1420771.6
Aug. 12, 2015 (GB) ..... 1514222.7
Aug. 12, 2015 (GB) ..... 1514226.8

(51) Int. Cl.
*A47L 13/26* (2006.01)
*A47L 11/40* (2006.01)
*A47L 13/22* (2006.01)

(52) U.S. Cl.
CPC ..... *A47L 13/26* (2013.01); *A47L 11/4088* (2013.01); *A47L 13/22* (2013.01)

(58) Field of Classification Search
CPC ..... A47L 13/22; A47L 13/24; A47L 13/26
See application file for complete search history.

(56) References Cited

U.S. PATENT DOCUMENTS 5,782,991 A * 7/1998 van der Heyden ..... A47L 13/26 134/26
6,227,744 B1 * 5/2001 Fodrocy ..... A47L 13/22 401/137

(Continued)

FOREIGN PATENT DOCUMENTS

CN 202619592 U 12/2012
GB 2436786 A 10/2007

(Continued)

*Primary Examiner* — Jennifer C Chiang
*Assistant Examiner* — Bradley Oliver
(74) *Attorney, Agent, or Firm* — Felix L. Fischer

(57) ABSTRACT

A floor cleaning apparatus, comprises a head, the head having a downward facing cleaning element for downward facing cleaning of a ground surface; and a handle for holding; wherein a portion or a whole of the handle is removably attachable from the head and comprises a spraying system, the spraying system itself comprising a spray outlet; the spraying system operable in a first or a second mode, the portion or a whole of the handle attached to the head in the first mode; and the portion or a whole of the handle removed from the head in the second mode, wherein in the first mode spray is sprayable from the spray outlet upwardly with regard to the ground surface. In an alternate aspect, a floor cleaning apparatus, comprises a head, the head having a downward facing cleaning element for downward facing cleaning of a ground surface; and an upward spraying system, the upward spraying system comprising an upward spraying spray outlet.

16 Claims, 5 Drawing Sheets

(56) References Cited

U.S. PATENT DOCUMENTS

| | | | | |
|---|---|---|---|---|
| 6,692,172 | B1 * | 2/2004 | Hsu | A47L 13/22 15/104.93 |
| 2014/0082870 | A1 * | 3/2014 | Digiammarino | A47L 13/24 15/150 |

FOREIGN PATENT DOCUMENTS

| | | | |
|---|---|---|---|
| JP | 2011172740 | A | 9/2011 |
| JP | 2011194147 | A | 10/2011 |

* cited by examiner

UPWARD SPRAYING FLOOR CLEANING APPARATUS

REFERENCE TO RELATED APPLICATION

The present application claims priority of U.S. provisional application Ser. No. 62/072,539 filed on Oct. 30, 2014, GB application serial no. GB1420771.6 filed on 21 Nov. 2014, GB application serial no. GB1514222.7 filed on 12 Aug. 2015 and GB application serial no. GB1514226.8 filed on 12 Aug. 2015, the disclosures of which are incorporated herein by reference.

BACKGROUND

Spray functionality for floor cleaning apparatuses (in particular, brooms) has been known for some time. However, such apparatuses tend to spray forwardly or downwards so as to spray the floor surface and/or area in front of the apparatus with spray.

SUMMARY OF THE INVENTION

One of the intents of the present invention (particularly in preferred embodiments) is to facilitate upward spraying for floor cleaning apparatuses, so that upward surfaces, above height of a head of the apparatus, can be sprayed.

Furthermore, it would be desirable, according to one aspect of the invention, if a spraying system could be removed and used when separated from the head of the apparatus.

Thus there is provided, according to a first aspect of the invention, a floor cleaning apparatus, comprising: a head, the head having a downward facing cleaning element for downward facing cleaning of a ground surface; and a handle for holding; wherein a portion or a whole of the handle is removably attachable from the head and comprises a spraying system, the spraying system itself comprising a spray outlet; the spraying system operable in a first or a second mode, the portion or a whole of the handle attached to the head in the first mode; and the portion or a whole of the handle removed from the head in the second mode, wherein in the first mode spray is sprayable from the spray outlet upwardly with regard to the ground surface.

The term 'downward facing cleaning element' should be taken broadly as all floor cleaning apparatuses comprise a downward facing cleaning element; for a push broom, the downward facing cleaning element tends to comprise bristles; for a vacuum cleaner, the downward facing cleaning element comprises a suction element, etc, etc.

Preferably spray is sprayable upwardly, more preferably sprayable upwardly at an angle of 45 degrees or more with regard to the ground surface and/or angle of the head 12.

Such apparatuses tend to comprise at least one reservoir (typically a fluid reservoir).

The apparatus may be an apparatus for indoor cleaning of a ground surface (e.g. for cleaning a ground surface of a house), or may be an apparatus for cleaning an outdoor ground surface (e.g., as one example, wherein the invention is a rake).

In one preferred embodiment, the handle is removably attachable to a plurality of different floor cleaning heads, so that the spraying system can be used as part of multiple different floor cleaning apparatuses. Thus there may be provided a universal attachment system, wherein the handle is universally attachable to a plurality of different heads.

According to a second aspect of the invention, (and not relying on removable attachability with regard to the spraying system), there is provided a floor cleaning apparatus, comprising: a head, the head having a downward facing cleaning element for downward facing cleaning of a ground surface; and an upward spraying system, the upward spraying system comprising an upward spraying spray outlet.

The apparatus may, for example, be a robotic floor cleaning device, and may in certain embodiments not comprise a handle.

BRIEF DESCRIPTION OF THE DRAWINGS

The present invention will now be more particularly described, with reference to the accompanying drawings, by way of example only and in no way limiting a scope of the invention, in which.

DETAILED DESCRIPTION

Figure 1A:
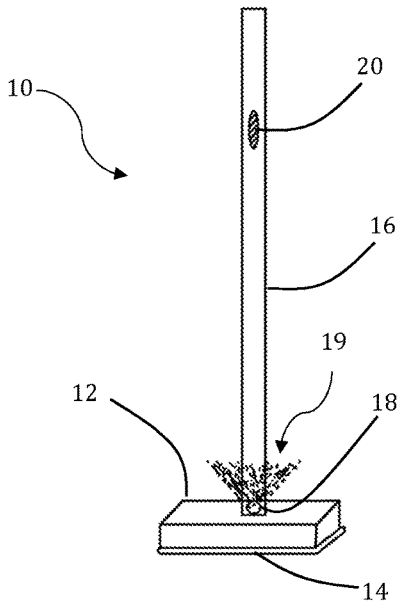
FIG. 1A is a front view of one embodiment of a floor cleaning apparatus according to a first aspect of the invention, wherein the invention is shown in a first mode with handle attached.
Figure 1B:
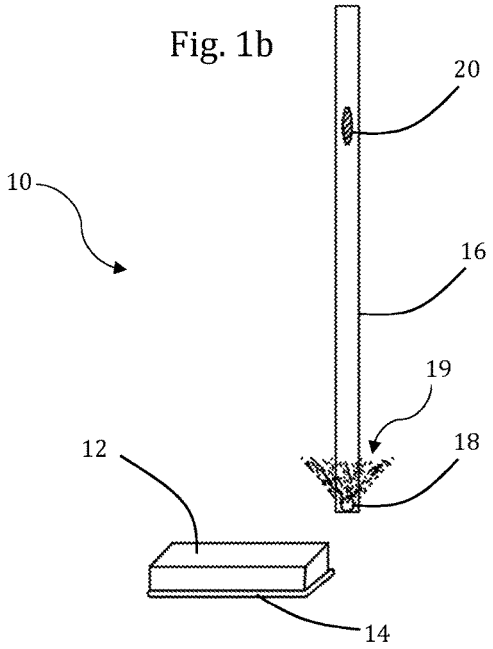
FIG. 1B is a front view of the same embodiment as FIG. 1A, shown in a second mode with handle removed.

Referring to FIGS. 1A, 1B, 2A, 2B, 3A, 3B and 4A, 4B, there is provided a floor cleaning apparatus 10, comprising: a head 12, the head 12 having a downward facing cleaning element 14 for downward facing cleaning of a ground surface; and a handle 16 for holding; wherein a portion 16' or a whole 16 of the handle 16 is removably attachable from the head 12 and comprises a spraying system, the spraying system itself comprising a spray outlet 18; the spraying system operable in a first or a second mode, the portion 16' or the whole 16 of the handle 16 attached to the head 12 in the first mode; and the portion 16' or the whole 16 of the handle 16 removed from the head 12 in the second mode, wherein in the first mode spray is sprayable from the spray outlet 18 upwardly with regard to the ground surface. It is shown clearly that the spraying system is functional in both the first and the second mode. (See particularly FIGS. 1A and 1B, and 2A and 2B).

(Where the downward facing element 14 cannot be seen in the drawings, it may be numbered with a dashed arrow).

In FIGS. 1A, 1B, 2A, 2B and 3A, 3B, a whole 16 of the handle 16 is removably attachable from the head 12. In FIGS. 4A and 4B, a portion 16' of the handle 16 is removably attachable. In embodiments where the portion 16' (rather than the whole 16) of the handle 16 is removably attachable, the portion 16' need not be directly attachable to the head 12, and may, for example, be removably attachable from the handle 16 and not directly connected to the head 12. Nevertheless, it is termed removably attachable from the head 12 in so far as it can clearly be separated from rest of the apparatus (inclusive of the head 12) to be used separately. (Clearly shown in FIG. 4B). Thus even if the portion 16' is not directly in contact with the head 12 when it is attached to the handle 16, it nevertheless is removably attachable from the head 12 in so far as it can be separated from rest of the apparatus (inclusive of the head 12) when removed.

Referring particularly to FIGS. 1A, 1B, 2A and 2B, there is shown a representation of the invention 10 (not intended to be true-to-life, but as a representation of the invention 10).

In FIG. 1A there is shown a front view. The invention 10 shown may be a Swiffer® type floor cleaning apparatus, or may be any floor cleaning apparatus, such as a broom, vacuum cleaner, mop, etc., etc.

The head 12 has a downward facing cleaning element 14 for cleaning a ground surface. In the shown example of FIGS. 1A and 2A, the downward facing cleaning element is (or comprises) a cloth type ground cleaning element, which may be useful for cleaning a hard ground surface (for example a kitchen floor). However, the downward facing cleaning element may, for example, comprise a suction element if the floor cleaning apparatus is a vacuum cleaner of any sort (e.g. an upright vacuum cleaner, or a wand head (canister) vacuum cleaner, (where the head 12 is a wand head)). If the apparatus is a broom, for example. the downward facing cleaning element 14 may comprise a brush element, which brush element may comprise bristles.

The downward facing cleaning element 14 may comprise multiple cleaning elements.

Referring to the handle 16, the handle 16 (or a portion 16' of the handle) comprises a spraying system, which itself comprises a spray outlet 18. The spray outlet 18 is preferably provided toward a base of the handle 16 (and/or portion 16'), in proximity to the head 14.

The spray outlet 18 comprises at least one spray aperture (ie opening) so that spray 19 can be sprayed. The spray outlet 18 may comprise a plurality of spray apertures. The spray outlet may comprise a spray nozzle. The spray nozzle may be an atomizing nozzle to promote a mist-type spraying. The spray, in any embodiment, may be a mist. The spray may be fluid spray.

Figure 2A:
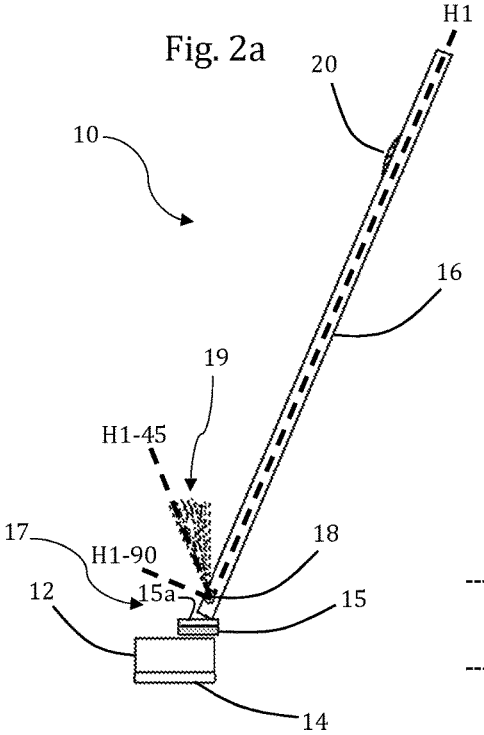
FIG. 2A is a side view of a same or similar embodiment as shown in FIGS. 1A and 1B, wherein the invention is shown in a first mode with handle attached.

Spray 19 can be seen sprayed from the apparatus 10 in FIGS. 1A and 2A. As shown (particularly in FIG. 2A, side view), in a particularly preferred embodiment, spray 19 can be sprayed at an angle greater than 45 degrees upwardly, preferably from about a base portion of the handle 16. Thus, when the downward facing cleaning element 14 is optimally engaging the ground surface, spray 19 is preferably sprayable upwardly at an angle of 45 degrees or more, and may feasibly be sprayable upwardly at an angle approaching (or substantially at) 90 degrees (i.e. substantially directly upwards with regard to the ground surface and/or angle of the head 12). In one example embodiment, spray 19 may be sprayable approximately at an angle substantially between 45 degrees and 90 degrees, or mostly from between 45 degrees and 90 degrees, with regard to the ground surface.

The spraying angle is preferably at 90 degrees or less with respect to axis of the handle angle H1. (i.e. The spraying angle/angulation of spray is preferably at 90 degrees or less with respect to angle of the handle). This is shown in example embodiment of FIG. 2A, where axis H1 (denoted with dotted line) denotes the handle axis/angle of handle, and axis H1-90 (denoted with dotted line at 90 degrees to axis H1) denotes 90 degree angle with respect to the handle axis H1. It can be seen that the spray 19, in the shown example, is sprayed upwardly at an angle less than 90 degrees with respect to axis of the handle H1 (ie upward of axis H1-90).

Angulation differential between spraying (angle) and handle axis H1 may be even less than 90 degrees, such as 80 degrees, 70 degrees, 60 degrees, 50 degrees, 45 degrees, 40 degrees, 30 degrees, or any other degree amount approaching zero differential with regard to handle axis H1, which any other degree amount may feasibly be claimed.

Figure 2B:
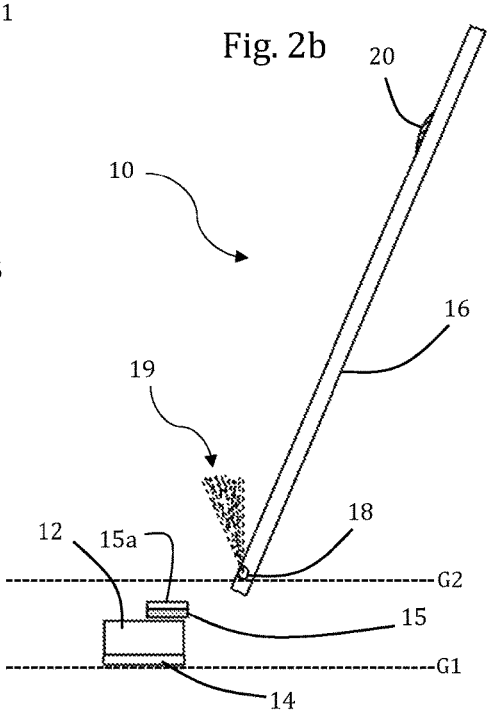
FIG. 2B is a side view of the same embodiment as FIG. 2A, shown in a second mode with handle removed.

Thus the shown differential in angle between spray angle and handle axis is less than 90 degrees in the shown example of FIGS. 2A and 2B. In the shown example, spray 19 is sprayable at an angle differential from the handle axis H1 of approximately 45 degrees.

This is best shown in the example embodiment of FIG. 2A, where axis H1-45 denotes an angulation of 45 degrees with reference to handle axis H1. It can be seen in the shown example that some spray 19 is sprayed at an angulation differential of more than 45 degrees, with majority of spray 19 being sprayed at an angulation differential of less than 45 degrees with reference to handle axis H1. In the example embodiment, it is shown that the axis H1-45 substantially bisects the spray 19 and spraying angle.

Angulation differential with respect to handle axis H1 as acute as that shown in FIG. 2A is an extreme example; in a preferred embodiment, spray angulation may be in an area approximately between 45 and 90 degrees with respect to handle axis H1 (ie spray may be angled to spray outwardly generally between axis H1-90 and axis H1-45). An angulation differential of approximately 70 degrees with respect to handle axis H1 may be optimal for spraying.

There is shown in FIG. 2B axis G1, denoting plane of the ground surface at ground surface level. Axis G2 denotes the same plane shown just below the spray outlet 18 in order to clearly show that some of the spray 19 (or in the shown example, all of the spray 19) is sprayable upwardly with regard to the ground surface. Thus the spray 19 (all or some of) is sprayable upwardly with regard to the ground surface (and the ground surface axis G1).

In a preferred embodiment, the angle of spray from the handle is determined by the angle the handle of the apparatus is held at. For example, the spray outlet 18 of the handle may not be upward facing and/or upward spraying when the handle ascends from the head directly upward, substantially perpendicular to the ground surface. However, when attached to the head, when the handle is angled (ie in normal use), the spray outlet is intended to spray upwardly.

With reference to FIGS. 1A, 1B, 2A, 2B, 3A, 3B, 4A and 4B, the handle 16 (or a portion' of the handle 16) is shown fully detachable from the head 12, with the spraying system operable in a first mode or a second mode, the portion 16' or a whole 16 of the handle 16 attached to the head 12 in the first mode; and the portion 16' or a whole 16 of the handle 16 removed from the head 12 in the second mode.

In FIGS. 1A, 1B, 2A, 2B, 3A and 3B, the whole handle 16 is detachable from the head 12, with the spraying system operable in the first mode, and in the second mode.

In FIGS. 4A and 4B, a portion 16' of the handle 16 is detachable from the head 12, the portion 16' comprising the spraying system, with the spraying system operable in the first mode when the portion 16' is attached, and in the second mode when the portion 16' is removed.

(As aforementioned, in an embodiment where the portion 16' is detachable and usable separately (eg FIG. 4B), it is feasible the portion 16' is never directly attached to the head, but forms a part of the handle (when attached to the handle), which handle is attached to the head in the first mode. The portion 16', in such an embodiment, can then be detached from rest of the handle, and is therefore said to be detached from the head, since, in such an embodiment, it is clearly (once removed from rest of the handle) no longer in any way attached to the head).

It will be obvious from a user point of view that it would be extremely desirable if the portion 16' or a whole 16 of the handle 16 were substantially instantly (or instantly) removable, so that it could easily be removed for use separately from the head 12 of the apparatus 10.

Thus, in a preferred embodiment, the apparatus 10 comprises a quick release system (which preferably is, or comprises, a quick release mechanism) for facilitating substantially instant removable attachability of the portion 16' or a whole 16 of the handle 16. (The 'quick release system' may also be defined as a 'quick connect system', which quick connect system preferably is, or comprises, a quick connect mechanism). Thus the user can substantially instantly remove (and then reattach) the portion 16' or a whole 16 of the handle 16 without need to unscrew screws, or use significant force, etc. (The term 'system' with reference to 'quick release system' is a broad term including any solution under the Sun for quick release of the handle (or a portion 16' of the handle). The system may, for example, be electronic, but is preferably a mechanism).

It will be obvious to those with skill in the art that there are a vast array of ways of carrying out a quick connect system and/or mechanism.

More specifically, the quick release system (which is preferably a quick release mechanism) preferably comprises a quick foot release means, so that a user, simply by engaging a part of the apparatus 10 with their foot, can release the portion 16' or a whole 16 of the handle 16. (ie in an embodiment, for example, where the whole handle is removably attachable, preferably the whole handle can be released by the user simply engaging a part of the apparatus 10 with their foot).

Referring to FIG. 2, in what is intended to be a basic representation of the invention (and not an exact true-to-life illustration), there is shown a neck part 15, which is located between the handle 16 and the head 12. The general area about where the head 12 and handle 16 meet may be termed the 'neck area' 17.

Preferably, if a quick foot release means is provided, it is provided about the head 12 or neck area 17 of the apparatus. (The neck area 17 (which is a general area), may include a lower portion of the handle 16 since the neck area 17 is the general area where the head and handle meet, and may also include the head 12 of the handle 16 in and around that area).

The neck part 15 may include a quick release mechanism (or a part of a mechanism) for releasing the handle 16. Such a neck part 15 is shown by way of example and representation only, and it will be extremely obvious to those with skill in the art that any quick release mechanism may be provided without need for a separate neck (or any) part 15, and may be formed integrally as part of the head 12 (or integrally as part of both the head 12 and/or the handle 16, the head and the handle being configured to releasably attach from each other, each of the head and handle being or comprising a part of the quick release mechanism).

The quick release system (which is preferably a mechanism and may comprise a quick foot release means) may, for example, comprise a clipping mechanism, where, for example, the handle 16 can be clipped into, for example, a cavity on the head 12 (or potentially clipped onto or into a protrusion from the head 12, or any other part). Such a clipping mechanism may require a relationship between the handle part that is clipped about the head or neck 17 of the apparatus 10, and the attachment point about the head 12 or neck 17 of the apparatus it is clipped to, so that clipping can occur, so that the handle 16 can be released, and be reattachable, via the clipping mechanism. The relationship may be a male-female attachment mechanism, and vice versa (female-male). Such a relationship between handle and head need not be limited to clipping mechanisms, and may be provided for any quick release system (particularly where the quick release system is a quick release mechanism). It will be obvious that such relationship(s) may exist between the handle 16 and the neck part 15, if the handle is releasable and reattachable to the neck part 15 rather than directly to the head, and in such a case, nevertheless, the or any neck part 15 is considered part of the head if it remains attached to the head 12 when the handle 16 (or a portion 16' of the handle 16) is released from the head 12.

The quick release system (which is preferably a mechanism) may, for example, comprise a twist and lock mechanism, where the handle 16 can be twisted (and untwisted) to attach and remove the handle 16 from the head 12 of the apparatus 10.

Alternatively, it is feasible a release system is provided which is not 'quick' in such a way. For example, a release system may be provided wherein the release system is a screw system, the handle 16 for example being screwable into, and unscrewable from, the head 12 (the neck part 15 may be considered part of the head 12 in such an embodiment where the handle 12 is attachable and releasable from the neck part 15). Such screw attach and release systems tend to comprise a male thread going into a female thread. The handle 16, in such an embodiment, will tend to have a thread, the head attachment location also tending to have a thread, handle 16 thus screwable into, and unscrewable from, the head 12 (perhaps via a neck part). As it is described for the handle 16, so it may feasibly be for the portion 16' of the handle 16. (Any feature(s) described with reference to the handle 16 may be afforded (and may be claimed) for the portion 16' of the handle 16).

In an embodiment where there is provided a quick release system (the quick release system preferably being a quick release mechanism), wherein the quick release system/mechanism comprises a quick foot release means, the quick release system/mechanism may comprise a foot release element, which may, for example, be a protrusion, or a pressurable portion (such as a pressure pad on the head, for example), which is configured so that the user can release the handle 16 (or a portion 16' of the handle 16) from the head 12 via manipulation of the foot release element with their foot. It will be obvious this could be a particularly intuitive way of facilitating removal of the handle 16 (or a portion 16' of the handle 16) by the user, since they would not have to bend down.

Such a foot release mechanism, for example, may comprise any of: a button (to be pressed and/or moved by the user's foot); a pressurable portion (such as a pressure pad 15*a*) which could be stood on by the user's foot (and may be located on the head 12 of the apparatus 10), thus facilitating release of the handle 16 (or a portion 16' of the handle 16); a protruding element (such as a protruding flange as subsequently shown described with respect to FIGS. 7*a* and 7*b* as quick foot release element 32), which may be manipulated (such as stepped on and/or depressed and/or moved) by the user's foot, thus facilitating release of the handle 16 (or a portion 16' of the handle 16). Such examples of a foot release mechanism are given by way of example only, in no way limiting a scope of the invention 10, and it will be clear that there are many ways of achieving a quick release system of such a type.

The foot release mechanism (if provided) is preferably provided any of: on the head 12; on a base and/or lower portion of the handle 16; and/or about the neck area 17 of the apparatus.

Preferably the quick release system (which is preferably a quick release mechanism) is provided about the head 12 or neck area 17 of the apparatus. 'About' is here intended to mean 'in the general area of'. The neck area 17 may include a base portion (ie lower part) of the handle 16 close to the head 12, and may include an area of the head 12 close to the handle 16.

In an alternate embodiment, it is possible the quick release system (which is preferably a quick release mechanism) may comprise a user means for quick release provided on or about the handle 16 or a portion 16' of the handle 16. There may, for example, be provided a depressible spring-loaded button (or any user means for quick release) toward a top of the handle 16 or a portion 16' of the handle 16, which, when pressed and/or manipulated, may initiate release of the handle 16 or a portion 16' of the handle 16. Thus such an embodiment may provide a user means for release of the handle 16 or a portion 16' of the handle 16 which is intended and configured for manipulation by a hand (and/or digit(s)) of a user. This is just one example of such a user means, and it will be obvious that there are many ways of carrying out a user means for quick release, provided on or about the handle 16 or a portion 16' of the handle 16. Any button may be provided (not limited to spring-loaded, etc.).

The spraying system (whether the whole handle 16 or a portion 16' of the handle 16 comprises the spraying system) tends to comprise a reservoir, which is typically a fluid reservoir for holding fluid. The reservoir tends to hold matter which is sprayed from the spray outlet. Such matter may include (or be) water, may include bug repellent, may feasibly include pesticide(s), may include fragrancing matter (such as fragranced fluid), or any other matter to be ejected/sprayed from the apparatus.

In one preferred embodiment, the matter comprises (and/or is) essential oil(s). Essential oil(s) can be beneficial both in term of fragrancing, and in terms of repelling bugs.

The reservoir may be an aerosol type reservoir. (The spraying system may be an aerosol type spraying system). The reservoir may hold gas (which gas may be compressed). Preferably the reservoir holds fluid matter.

For the sake of the present application, the term 'reservoir' is used to define an area or part of the apparatus for holding matter to be sprayed. If the reservoir is configured, or intended, for holding fluid, it is referred to as a 'fluid reservoir').

The reservoir is preferably included within the handle 16 or a portion 16' of the handle 16, but may be attachable externally to the whole of or a portion 16' of the handle 16. If it is attached/attachable externally, bracket(s) (or any other holding means) may be used to attach the reservoir, the portion 16' or a whole 16 of the handle 16 thus further comprising bracket(s).

As shown in FIGS. 1A, 1B, 2A, 2B, 3A and 3B, where the whole handle 16 is removably attachable, and in FIGS. 4A and 4B, where the portion 16' of the handle 16 is removably attachable, the portion 16', or the whole of, the handle 16 preferably comprises a user selector 20 to allow the user to initiate spraying from the spray outlet 18. Preferably the user selector 20 is provided toward a top of the handle 16 (or portion 16'). Intent of such a preferred positioning is that the selector 20 is close to where the user holds the handle 16 (or portion 16') so that minimal effort and/or movement is required for them to initiate spraying (eg via manipulation of a finger(s)).

The user selector 20 may, for example, be a button, switch, may comprise a spring element, may be a spring loaded element (such as button, etc), may be a pressure pad element, or any other means. 'User selector' is a broad term including any selection means under the Sun. The user selector 20 is a means by which the user can select to spray the spray 19 from the portion 16' or whole of the handle 16. If the user selector 20 is, for example, a spring-loaded button, pressing of the spring-loaded button by a user may, for example, open a channel so that spray can be sprayed from the spray outlet 18. (This is just one example of a spraying mechanism).

It is feasible the spraying system (and thus the handle 16 (or portion 16')) may comprise more than one reservoir (ie a plurality of reservoirs). For example, there may be one reservoir holding fragrancing matter, and one reservoir holding bug repellent matter. Alternatively, for example, if the apparatus were used by an exterminator, there may be provided one reservoir with a pesticide to kill one type of pest, and another reservoir with a pesticide to kill a different type of pest.

In such a case where there are provided a plurality of reservoirs, the spraying system (and thus the portion 16' or a whole of the handle 16) may comprise means for selectably independently choosing spraying from each reservoir. Such means may comprise, for example, a plurality of selectors 20 which correspond to the plurality of reservoirs.

Thus, in the example stated above (taken by way of example only), wherein there is provided a reservoir holding fragrancing matter and a reservoir holding bug repellent matter, there may be provided (preferably about a top portion (ie towards a top) of the portion 16' or a whole of the handle 16) a first selector 20 for selecting spraying from the first reservoir (fragrancing in this example), and a second selector 20 for selecting spraying from the second reservoir (bug repellent in this example). The different spray outputs (fragrancing and bug repellent) from the different reservoirs may be sprayable from the same spray outlet 18, or there may be provided a plurality of spray outlets as part of the portion 16' or a whole of the handle 16) for spraying from the different reservoirs (eg a first spray outlet for spraying from a first reservoir, and a second spray outlet for spraying from a second reservoir).

Thus the spraying system may comprise means for choosing spraying from each reservoir independently, (which means may comprise a plurality of selectors).

Alternatively (or in an alternate embodiment), it is feasible (for example in a mop floor cleaning apparatus embodiment) that there may be provided a plurality of reservoirs, wherein a spray can be sprayed forward or downward (eg water), and a spray can be sprayed upward (e.g. fragrancing, bug repellent, etc).

Thus, in one example embodiment, there may be provided one spray outlet (feasibly on the handle, neck area or the head) for forward or downward spraying (eg of water), with there being provided an alternate spray outlet on the handle (or portion 16' of the handle) for upward spraying of matter such as fragrancing matter, bug repellent, etc. Each spray outlet may spray matter from a different reservoir, and there may be provided separate user selectors to initiate spraying from each spray outlet/reservoir. The forward or downward spray may be sprayable from a spray outlet on the handle, for example, (which may be a downward spraying outlet). Both spray outlets, in such an example embodiment, may feasibly be provided on the handle (or portion 16'). Alternatively, only one of the spray outlets may be located on the removable handle 16 (or portion 16'), and the other (or another) spray outlet may be located on the head.

The (or any) reservoir may be removable, and may be removably attachable. The or any reservoir may be removable in such a way that the reservoir can be removed and a new reservoir attached. Thus the or each reservoir may act as a cartridge, which reservoirs may feasibly be sold (separately) as cartridges, thus facilitating 'reloading' of the spraying system. Alternatively, the reservoir(s) may be removable in such a way that the reservoir can be removed, feasibly refilled, with the same reservoir then being re-introduced/re-attached. The reservoir may be housed internally to the portion 16' or a whole of the handle 16, or may be attached (or removably attachable) externally. The reservoir tends to comprise an outer casing, so that matter can be held in the reservoir for spraying.

The reservoir may be removable and replaceable, functioning as a cartridge. It may be removable and replaceable in such a way that the same reservoir can be removed and replaced, used repetitively, or in such a way that the reservoir can be removed, with a new reservoir (which may be filled with new matter) replacing the old reservoir. Such reservoirs, functioning as re-fill cartridges, may be provided (and may be sold and/or marketed) separately.

As aforementioned, the spray outlet 18 is preferably located toward a base (ie lower area) of the portion 16' or a whole of the handle 16.

The spray outlet 18 (and/or a spray aperture of the spray outlet 18) is preferably upward facing in order to achieve upward spraying. The spray outlet 18 (and/or a spray aperture) is preferably upward facing substantially to 45 degrees or more with regard to the ground surface.

Direction of spray may be alterable by a user. This may be achieved via altering angle of the spray outlet 18 (ie the spray outlet may be adjustable). It may be achieved via altering angle of a spray aperture (ie angle of the spray aperture may be adjustable). This may be achieved manually by a user, or may be achieved via a system (preferably a mechanism) being provided for the user to facilitate alteration of direction of spray. Thus there may be provided a spray direction user altering system. Such a system (which is preferably a mechanical system) may comprise a user selector of some sort to facilitate alteration of spray direction in the aforedescribed, or any other, way. The term 'system' with reference to 'spray direction user altering system' is a broad term including any solution under the Sun for how to alter direction of spray. The system may, for example, be electronic. Preferably the system is a mechanism.

As shown in FIGS. 4A and 4B, in an embodiment wherein the portion 16' of the handle 16 is removably attachable, the portion 16' is preferably substantially stick-shaped, which may be beneficial in terms of easy usage by the user. Thus it is preferably (significantly) elongate and thin. In FIG. 4B, the portion 16' of the handle 16 is shown removed from the handle 16, the portion 16' including the spraying system. Preferably the portion 16' comprises an outer casing 22 that houses, or substantially houses, internal components, preferably of the spraying system. The outer casing 22 may, for example, be made of plastics type material (not limited to only plastics type material, or to being made of only one material). The reservoir may be provided internally, or externally to the casing 22. The reservoir may be removable, and may be removably attachable. The outer casing of the portion 16' (in such an embodiment) may house the reservoir (s), reservoir(s) housed internally in the portion 16', which reservoir(s) may be removably attachable in any way described previously.

Figure 3A:
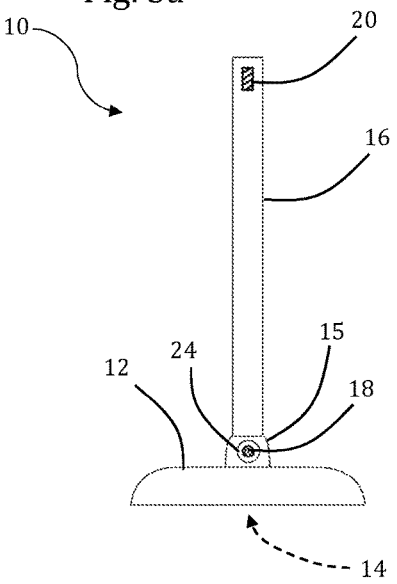
FIG. 3A is a front view of a similar embodiment wherein the handle is attachable to the head via a neck part, shown in a first mode with handle attached.
Figure 3B:
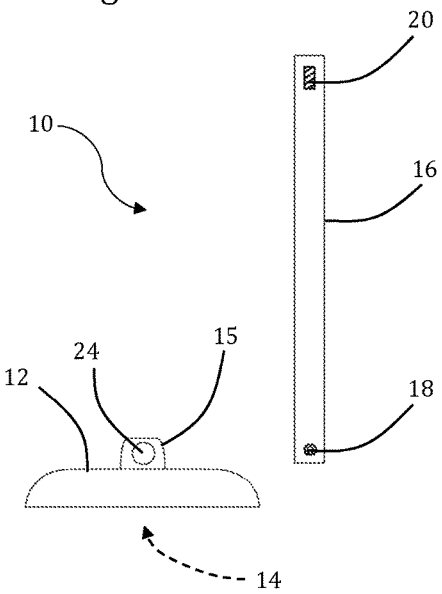
FIG. 3B is a front view of the same embodiment as FIG. 3A, shown in a second mode with handle removed.
Figure 4A:
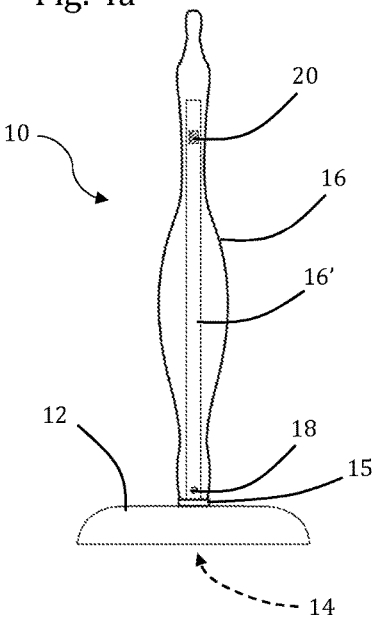
FIG. 4A is a front view of the invention, wherein a portion, rather than a whole of, the handle is removably attachable, the invention shown in a first mode with portion attached.
Figure 4B:
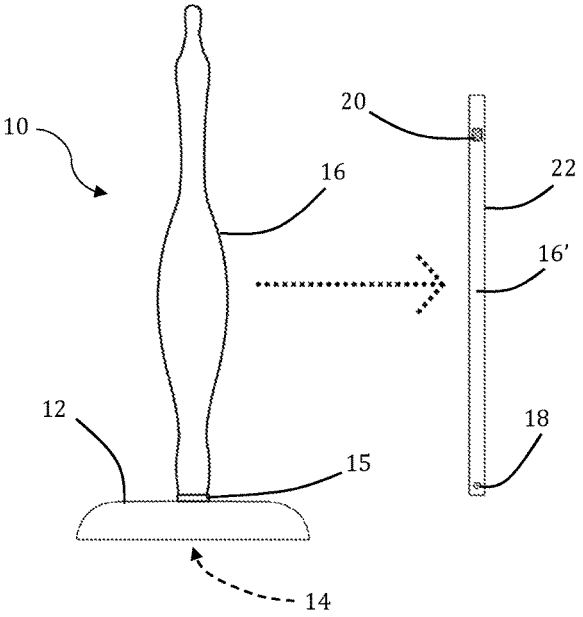
FIG. 4B is a front view of the same embodiment as FIG. 4A, shown in a second mode with portion removed.

Referring to FIGS. 3A and 3B, there is shown an embodiment of the invention 10 wherein the apparatus 10 comprises a neck part 15, into which neck part 15 the handle 16 (or feasibly a portion 16' of the handle) may be insertable to facilitate attachment of the handle 16 (or portion 16'). The neck part 15 preferably comprises a cavity into which the handle 16 can be inserted, which preferably 'locks' the handle 16 into place. In the shown example, the neck part 15 comprises a neck part aperture 24 so that spray 19 can be sprayed out of the handle 16 when it is inserted into the neck part 15, spray 19 spraying out of the spray aperture 18, and also through the neck part aperture 24.

In the shown examples of FIGS. 1A, 1B, 2A, 2B, 3A and 3B, the handle 16 is shown removably attachable from just one head 12 (possibly via a neck part 15). However, there may be particular benefits if the handle 16 can be detached, for example, from one head, and then re-attached to a different head. For example, the handle 16 may be removable (releasable) from a broom head, only to then be attachable to a Swiffer®-type head, or any other head, to be used as part of a different floor cleaning apparatus.

In this way, the handle 16 (and thus the spraying system) may be universally attachable to a plurality of different heads 12. This may be achieved via a universal attachment system (which may also be defined as a 'universal release-and-attach solution', which solution may be any means, mechanism, system etc of facilitating removable attachability of the handle to a plurality of different floor cleaning heads), facilitating use of the handle 16 (and thus the spraying system) on a plurality of different (and preferably different types of) floor cleaning heads, and the handle 16 thus forming (and being used as) the handle 16 of a plurality of different floor cleaning apparatuses.

Thus the handle 16 may be universally attachable to a plurality of different heads 12. Thus there may be provided a universal attachment system, wherein the handle is universally attachable to a plurality of different heads. The term 'universal attachment system' is a broad term, including any solution under the Sun for universally attaching the handle to a plurality of different floor cleaning apparatus heads.

The benefits of this will be obvious; money and space may be saved by the user, who may no longer require several whole separate floor cleaning apparatuses (each with different handles), but now may instead own a plurality of floor cleaning heads, each one of which the handle is interchangeably attachable to (and releasable from).

This (universal use on a plurality of different floor cleaning apparatus heads) may also be the case in an embodiment where only the portion 16' of the handle comprises the spraying system, in which case, either the whole handle 16 may be universally attachable and usable with a plurality of different heads 12, the portion 16' then itself also being separately removably attachable from the whole handle 16, or, feasibly, the portion 16' may itself be universally attachable to a plurality of different handles 16 of different floor cleaning apparatuses, wherein the floor cleaning apparatuses all have their own handles.

Thus the portion 16' of the handle 16 may be universally attachable to a plurality of different floor cleaning apparatus handles 16 (which handles may themselves feasibly be attached or attachable to different heads 12).

In other words, the portion 16' may be universally removably attachable to a plurality of different floor cleaning apparatus handles, there being provided a universal portion 16' attachment solution for attaching the portion 16' to a plurality of different handles 16. Alternatively, the portion 16' may be universally removably attachable to a plurality of different floor cleaning apparatus heads, there being provided a universal portion 16' attachment solution for attaching the portion 16' to a plurality of different heads 16.

It will be obvious that such universal solution as hereinbefore described (particularly with reference to universal attachment of the handle 16) may, for example, comprise an attachment solution part on the handle, and an attachment solution part on the head, which attachment solution parts, when married, form a whole of or a part of the universal attachment solution/system. (Similar may be the case for a universal portion attachment solution, which may comprise an attachment solution part on the portion 16', and an attachment solution part on the handle and/or head).

As with many floor cleaning apparatuses, the handle 16 of the apparatus 10 may be angled by the user during use, and it may be possible for the user to alter angle of the handle 16 of the apparatus 10 with respect to the head 12 and/or the ground surface 100.

Figure 5:
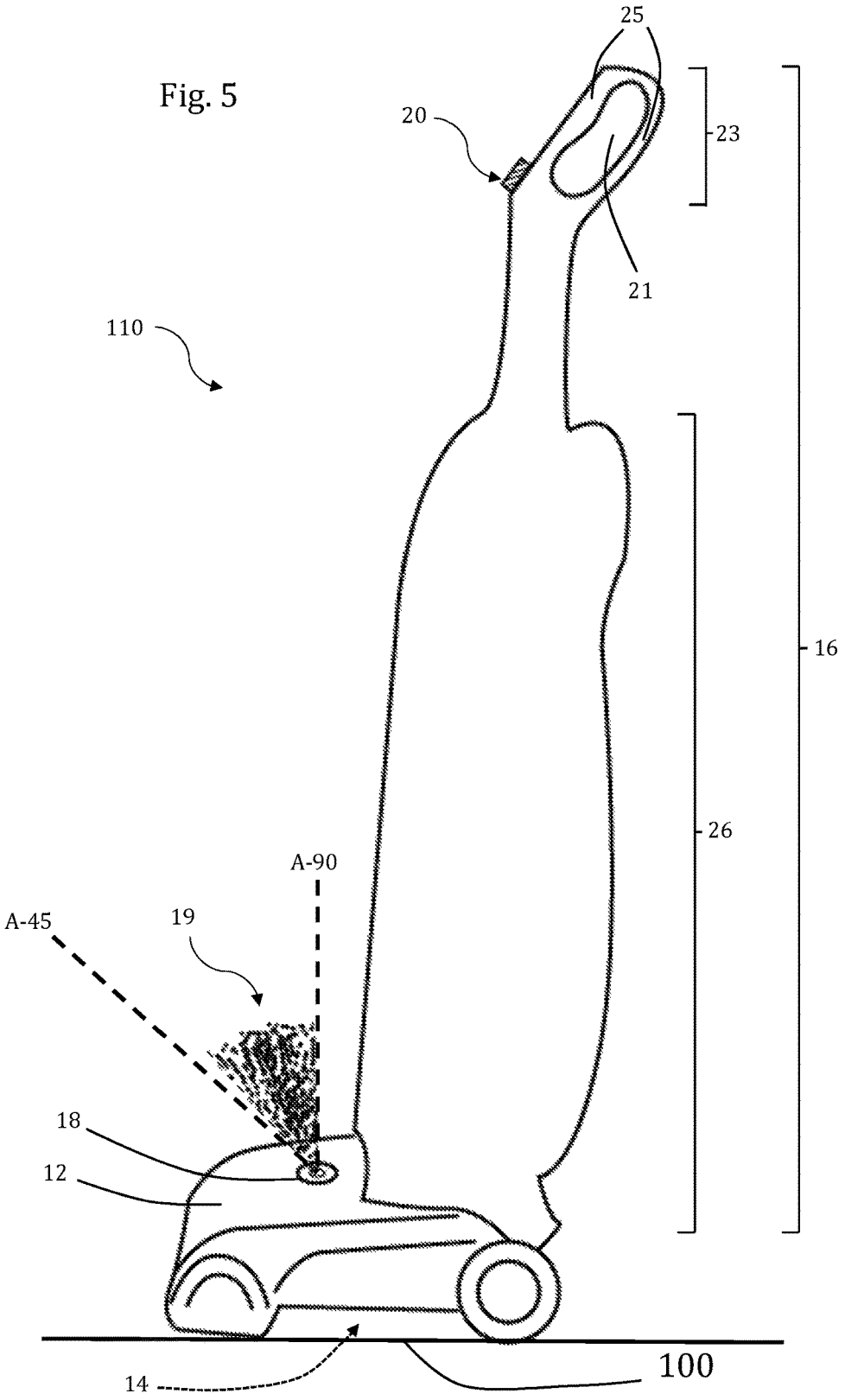
FIG. 5 is a side view of an embodiment of a floor cleaning apparatus according to a second aspect of the invention.

Referring to FIG. 5, there is shown a floor cleaning apparatus 110, comprising: a head 12, the head 12 having a downward facing cleaning element 14 for downward facing cleaning of a ground surface; and an upward spraying system, the upward spraying system comprising an upward spraying spray outlet 18. (The ground surface is denoted with the number 100). Preferably, as stated (and shown in FIG. 5), spray 19 is sprayable from the spray outlet 18 at an angle of 45 degrees or greater with regard to the head 12 and/or ground surface 100.

In such an invention, as shown, if a handle 16 is provided, the handle 16 (or a portion 16' of the handle) may not be removably attachable. (ie the handle may not be removable). The spray outlet 18 may be provided, as shown, on the head 12 (or any other location), most preferably on the head or about the neck of the apparatus, which may include a lower portion of the handle 16). The spray outlet 18 may be provided on the handle 16.

It is feasible some of the spray 19 is not so upwardly sprayed. Nevertheless, preferably some or all of the spray 19 is sprayed upwardly at an angle of 45 degrees or greater. In the shown embodiment (shown by way of example only), the spray 19 sprays generally from an angle of approximately 45 degrees to approximately 90 degrees. It is feasible it may spray (or be sprayable) to an angle more than 90 degrees on some models/embodiments.

This is clearly shown with the axis A-45 shown in FIG. 5, which shows a 45 degree upward angle with regard to the head 12 and the ground surface 100. It can clearly be seen that the spray 19 (in this case a whole of the spray 19) is directed at an upward angle greater than 45 degrees with regard to the ground surface.

Axis A-90 denotes an angle of spray of 90 degrees with regard to the head 12 and/or ground surface 100.

Thus it is clear in FIG. 5 that some or all of the spray 19 is sprayable upwardly at an angle of 45 degrees or greater. (Spraying angulation may be similar for the invention wherein a portion 16' or a whole of the handle 16 is removably attachable and comprises a spaying system.)

The spraying system is shown further comprising a user selector 20 on the handle 16, particularly close to a holdable portion 23 of the handle 16. As aforestated, the apparatus 110 may have all the optional and/or preferable features of the invention (and spraying system) as previously mentioned with regard to any other embodiment and/or aspect of the or an invention described previously in the present application. Therefore, for example, it may comprise two reservoirs (or any number, plurality); it may comprise a means for selectably choosing spraying from each reservoir, which means may comprise a plurality of selectors, etc, etc.

In the shown example, the holdable portion 23 of the handle 16 has a hand surround grip 25, which defines a holding aperture 21 into which a user's hand can fit to aid handling of the apparatus 110, which hand surround grip 25 may be provided for any floor cleaning apparatus which comprises a handle 16.

As aforementioned, the handle 16 of the apparatus may be angle-able for the user. Thus the user, during use, may hold the handle 16 at a more acute angle from the head 12 than is shown in FIG. 5. Thus the apparatus 110, for example of FIG. 5, may be used by a user, and in angling the handle 16 at a more acute angle from the head 12, the user may protrude the head 12 under cabinets, beds, etc (or any other overhang), and then use the spraying system to spray spray 19 from the spray outlet 18 upwardly, preferably having the spray 19 engage upward surfaces (such as an underside of a bed, cabinet, etc.). Such surfaces, in this way, can be fragranced, can be engaged with bug repellent, etc., etc., or any other sprayed matter.

In FIG. 5, the floor cleaning apparatus 110 is an upright vacuum cleaner and therefore further comprises a handle 16. (Note how the whole main body 26 (which main body, in the shown example, may, for example, include parts of a vacuum suction system) and the holdable portion 23 at the top of the apparatus 110 is termed the handle 16). The handle (and thus the apparatus 110) need not comprise (or have) a main body. Some apparatuses have clear linear handles that extend in substantially thin linear fashion from the head 12 of the apparatus (for example, wand heads on canister vacuum cleaner have a substantially thin linear handle extending from the wand head 12). In example embodiments such as that shown in FIG. 5, where the apparatus comprises a main body 26 (which main body 26 may be substantially bulky in size, and may comprise added (often very important) element(s) of the apparatus), for the sake of the present application, the holdable portion 23 towards the top of the apparatus (intended for holding by a user, standing as they hold the apparatus) and the main body 26, together are termed the handle 16.

If the floor cleaning apparatus 110 is a robotic device, (or in any other embodiment), it may not comprise/include a handle 16.

In the main body 26 of an embodiment such as that shown in FIG. 5, the main body 26 may comprise a reservoir, which reservoir is preferably a fluid reservoir.

Thus the spraying system of the floor cleaning apparatus 110 will tend to comprise a reservoir, and the spraying system may comprise any of the optional and/or preferable features as aforedescribed with reference to any other aspect of the invention (for example, the invention labelled number 10).

All essential, optional, and/or preferable features as aforementioned with regard to any aspect of the invention wherein the apparatus comprises a removably attachable portion 16' or a whole of the handle 16 may be afforded to this aspect of the invention 110 and may be claimed with regard to invention 110 (for example, optional features with regard to the spraying system, element(s) of the spraying system, matter sprayed by the spraying system, or any other feature(s). Therefore it may have all such optional and/or preferable features, and may even draw upon essential features of the removably attachable portion 16' or a whole of the handle 16 aspect of the invention (labelled number 10), which may be claimed dependently with regard to this interpretation of an upward spraying floor cleaning apparatus 110.

The floor cleaning apparatus 110 may be a robotic device. In such a robotic example/embodiment, it does not (or may not) comprise a handle 16. It is feasible, in an alternate embodiment, that it may comprise, for example, a removably attachable handle.

As will be known, such robotic cleaning devices tend to be automated so they can clean a floor without need for a user. Preferably, for such an embodiment, the downward facing cleaning element comprises a suction element for suction cleaning a floor. The downward facing cleaning element may also comprise brush element(s), which may aid cleaning.

In such a robotic embodiment, substantially the whole apparatus is the head 12, the robotic cleaning device preferably being substantially flat in shape, and preferably substantially circular in shape. Thus in such an embodiment, there is provided a robotic floor cleaning apparatus, comprising an upward facing spray outlet 18. Preferably the spray outlet can spray spray 19 substantially to 45 degrees or higher from the head 12 with regard to the ground surface and/or angle of the head 12. Thus the spray can engage and be sprayed upward onto upward surfaces, above the device 110.

The device thus preferably comprises a reservoir (which is preferably a fluid reservoir and is preferably internal to the device). The spraying system (and any comprising elements, such as spray outlet, reservoir, matter sprayed by the spraying system, etc, are afforded any of the optional and/or preferable features as aforementioned with regard to any aspect of the invention described previously in the present application, which optional and/or preferable features may be claimed with regard to such a robotic device. (The term robotic should be taken broadly here, in no way limiting such a device, and an alternate term 'automated' device may be used to represent and/or define such an invention 110).

Figure 6:
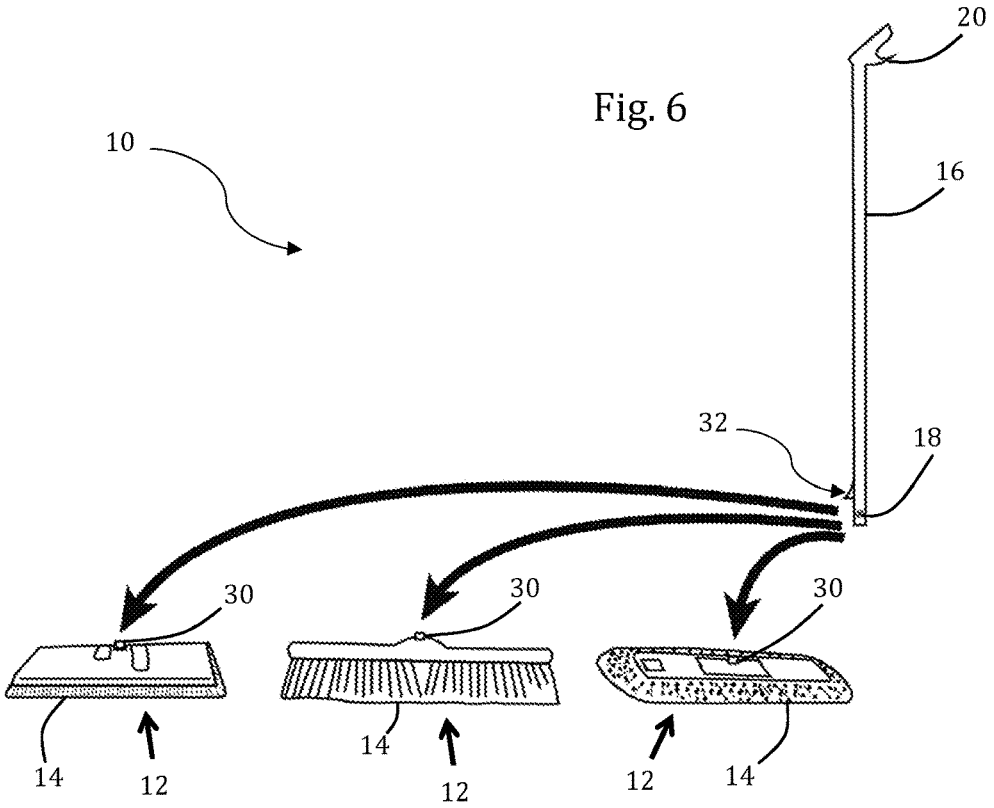
FIG. 6 shows a basic representation of the invention (according to a first aspect) wherein there is provided an embodiment of a universal attachment system, handle 16 of the apparatus attachable to a plurality of different heads.

Referring to FIG. 6, there is shown an embodiment (or basic representation) of the invention 10 wherein the handle 16 is universally attachable to a plurality of different heads 12, there being provided a universal attachment system. The universal attachment system, in the shown example, comprises a universal attachment solution part 30 on the plurality of heads 12. The left-most head 12 shown in FIG. 6 may be, for example, a spray mop head with disposable pad, or washable micro-fibre pad as the downward facing cleaning element 14; the middle-most head 12 shown in FIG. 6 may be, for example, a push broom head as the downward facing cleaning element 14 (in which embodiment, the apparatus 10 may further comprise upward and/or downward spray system(s) and/or outlet(s)); and the right-most head 12 shown in FIG. 6 may be, for example, a standard dust mop head with dust mop (cleaning) element as the downward facing cleaning element 14. If there are provided a plurality of selectable fluids and/or reservoirs sprayable from the apparatus, one of the reservoirs may comprise a fluid to prep and/or treat the mop (cleaning) element to facilitate adhering of dirt to the mop (cleaning) element. Thus in this (or any) embodiment, the removable handle (or a portion of the handle) may comprise both an upward spraying outlet and a downward spraying outlet (and/or an upward spraying system and a downward spraying system), with regard to the ground surface.

Thus in the shown example, the universal attachment solution part 30 on the heads are all the same (or substantially the same) so that the handle 16 (comprising the spraying system) can be attached (and detached) to any of the heads 12 interchangeably.

There is shown in the example a user selector 20 wherein the selector 20 in the shown example is a trigger, to activate spraying.

The example apparatus 10 of FIG. 6 is shown comprising a quick release system (which in the shown example is a quick release mechanism) for facilitating substantially instant removable attachability of the handle 16, wherein the quick release system (preferably a mechanism) comprises a quick foot release element 32, which is here represented as a protruding element 32 which protrudes from the handle 16 (preferably being located about the neck area 17 of the apparatus 10 when the handle is attached to one of the heads 12). Intent of the example representation is that the protruding element may be manipulated by a foot of a user, thus releasing the handle 16 from the head 12. This can be done in many ways, which will be obvious to those with skill in the art, and this is just one example embodiment of a foot release element 32.

Such an example of a universal attachment system is given by way of example only, and it will be obvious that the or any universal attachment system may comprise a female-male attachment solution (between handle and head(s)), or a male-female attachment solution, or any other attachment solution. In the shown example, the attachment solution is a male-female attachment system, where there is provided a male attachment solution part 30 on the head, with the handle, for example, having a cavity that the male attachment solution part 30 fits into. In such a case, the cavity on the handle may be defined as a female attachment solution part. However, the head may comprise a female attachment solution part, and the handle may comprise a male attachment solution part, or any other solution may be provided as part of the universal attachment solution.

Figure 7A:
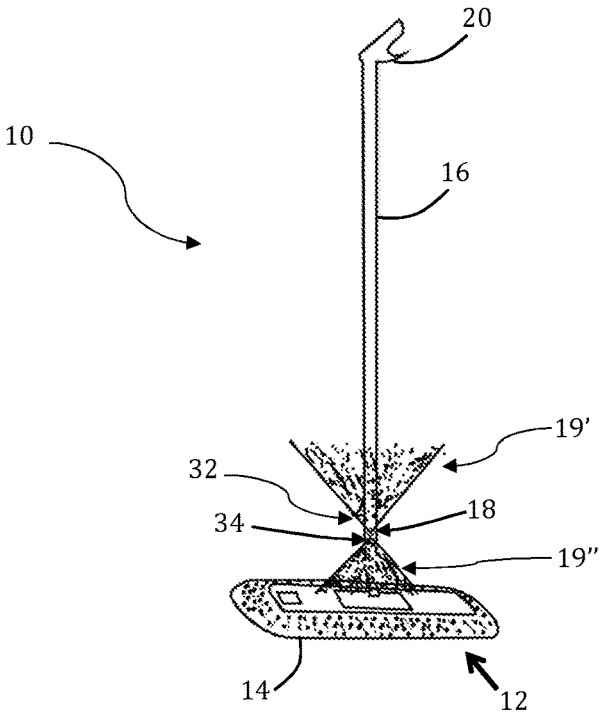
FIGS. 7*a* and 7*b* are a front view of an embodiment of the invention wherein the spraying system has facility for both upward and downward spraying and an expanded view of the embodiment depicting the plurality of reservoirs.
Figure 7B:
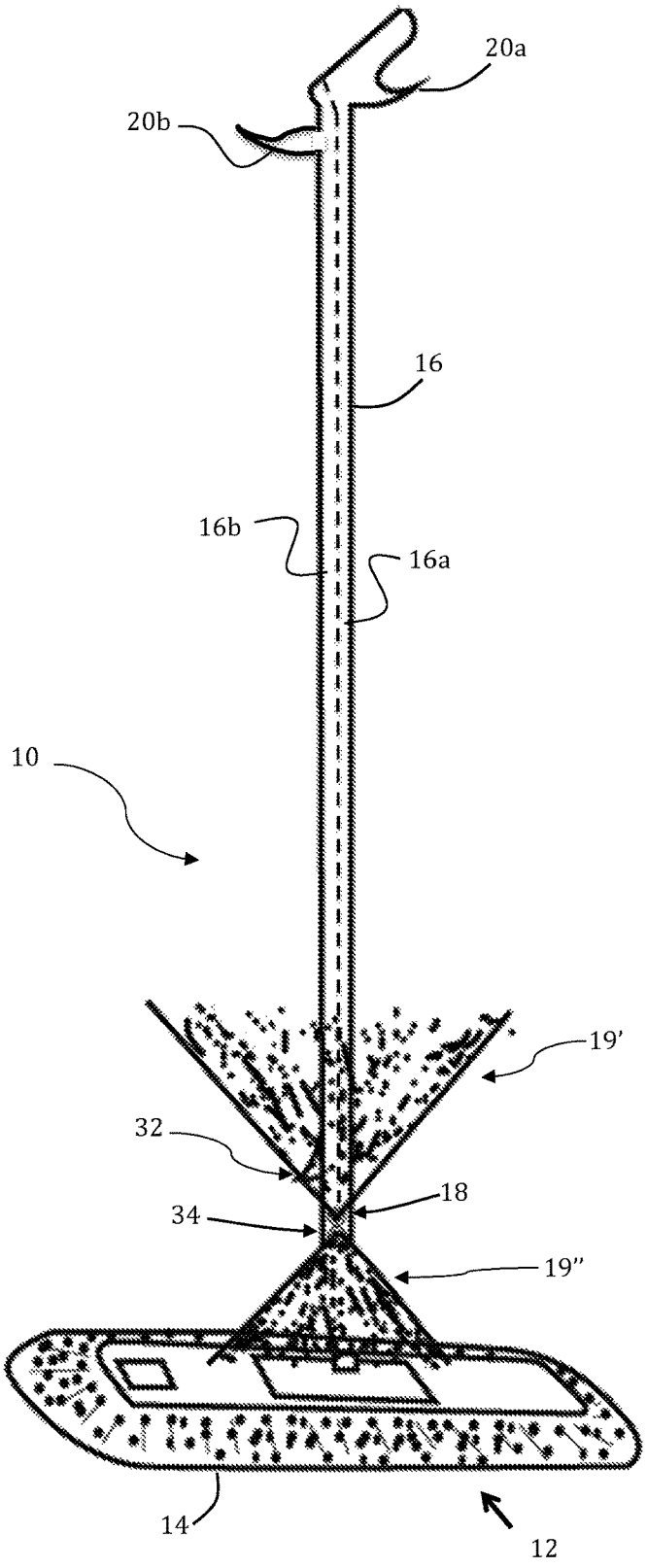

There is shown in FIG. 7*a* one example preferred embodiment of the invention wherein the handle 16 (or the portion 16' of the handle in an embodiment wherein only a portion 16' of the handle 16 is removably attachable and comprises the spraying system as previously described with respect to FIGS. 4*a* and 4*b*), is removably attachable and comprises the spraying system, wherein the spraying system comprises both facility for upward spraying, and downward spraying. (The handle 16 is shown detached from the head 12 in FIG. 7*a*).

Thus there is shown in FIG. 7*a* an upward spray 19' emanating from the handle, and a downward spray 19". (Note the upward spray 19' and downward spray 19" are shown simultaneously for artistic purposes—in a preferred embodiment, it is likely the sprays 19', 19" would be sprayed separately (rather than simultaneously) by a user, although it is feasible the upward spray 19' and downward spray 19" could be sprayed simultaneously).

Preferably, in such an embodiment, the spraying system (and thus the handle 16 or portion 16') comprises two spray outlets; one spray outlet 18 for upward spraying (which therefore may be defined as an upward spray outlet); and one spray outlet 34 for downward spraying (which therefore may be defined as a downward spray outlet). (These spray outlets 18, 34 can both be seen in the embodiment as shown in FIG. 7*a*). Thus in such embodiments, the spraying system may comprise both an upward spray outlet; and a downward spray outlet. It is also technically feasible that only one spray outlet may perform both upward and downward spraying, in which case, the spray outlet may be directionally adjustable so that spray angle can be altered by a user (which has previously been mentioned).

In such embodiments, the spraying system (and thus apparatus) tends to comprise a plurality of reservoirs (represented in FIG. 7*b* as elements 16*a* and 16*b*) with different matter in each reservoir (different for upward spraying and for downward spraying), although it is technically feasible there may be provided just one reservoir and same matter may be sprayed upwardly and downwardly. Preferably in such embodiments as shown in FIG. 7*b*, there is provided means for selectably independently choosing spraying from each reservoir (if there is provided a plurality of reservoirs), which means for selectably independently choosing spraying from each reservoir preferably comprises a plurality of user selectors 20. For example, there may be provided as shown in FIG. 7*b* two triggers shown in FIG. 7*b* as elements 20*a* and 20*b*, one for spraying upwardly, and one for spraying downwardly. Thus there may be provided a plurality of user selectors 20 to select spraying downwardly and upwardly. Thus there may be provided a plurality of user selectors 20 to select spraying from each spray outlet 18, 34. Thus there may be provided a plurality of user selectors 20 to select spraying downwardly and upwardly different matter, from different reservoirs.

(There may feasibly be provided more than two spray outlets, and may feasibly be means for selectably independently choosing spraying from more than two spray outlets).

In the shown example preferred embodiment of FIG. 7*a*, the apparatus comprises a quick connect system (which may also be defined as a quick release system), which quick release system comprises a quick foot release means, which quick foot release means comprises a quick foot release element 32 to facilitate quick release of the handle (or a portion 16' of the handle 16 as previously described with respect to FIGS. 4*b* and 4*b*) from the head, thus allowing the handle 16 (or a portion 16' of the handle) to be used separately. Again, the spraying system is operable in the first or the second mode, and the handle in the shown example has facility for both upward and downward spraying both when it is attached to the head, and when it is disconnected.

In Use

The invention 10 will now be described in use, with reference to a preferred embodiment(s) of the invention 10, in no way limiting a scope of the invention 10, and intended simply to better communicate the benefits and/or usage(s) of the invention 10.

In use, one of the intents of the invention 10 is to add new functionality to standard floor cleaning apparatuses, most preferably floor cleaning apparatuses that have pole type and/or pole shaped handle. In a case of floor cleaning apparatuses, such as, for example, mops of any sort, whether they be spray mops, wet mops, dust mops, sponge mops, ground squeegees, floor scrapers, brooms, sweeps, either mechanical or manual or of any other description, the present invention facilitates added functionality as hereinbefore described; for example added functionality of repelling insects via upward spraying.

In its most simple terms, in its preferred embodiment, the handle (or portion of the handle) adds functionality of a spray handle (or portion) to such (or any) floor cleaning apparatuses, preferably engineered to quick-connect to any, preferably pole type, floor cleaning apparatus, and one example primary intent of the invention is to spray an upward mist, possibly of insect repellent and/or (a variety of) essential oil(s) under, around, or above objects that are inaccessible to a user whilst performing general cleaning tasks while using a (preferably) pole type floor cleaning apparatus. Common causes of dirt and debris are often exacerbated by spider webs, where pet hair, sawdust, leaves and other debris are caught. By addressing and eliminating the reoccurrence of these webs by discouraging or eliminating the source (ie the spiders), time, money and back injuries can be minimized.

While mopping or sweeping a floor (as one example), the user may observe spider webs under a bed or storage rack (or any number of immovable objects). By activating a trigger (or any user selector), a pest deterring mist can be released in a generally upward direction in the vicinity of the insect. Should the floor cleaning apparatus head be too cumbersome to access an area, the user can quickly disconnect the handle (or portion) having the spraying system, from the head, preferably by a foot lever or button, and activate the trigger and spray the insect.

In an outdoor situation, for example, the handle (or portion) can be attached to a rake head or push broom head and when noticing spiders around a building foundation or wood pile, the rake or broom head can be detached and the handle (or portion) with spraying system of the invention can be directed toward the web and be activated. The same scenario would apply to warehouse maintenance.

It is envisioned that this device could replace a multitude of floor cleaning apparatuses in the home, industry cleaning closets and garages and the closet or janitorial cleaning carts, where it could be used with a vast variety of different cleaning heads to which the handle/portion may be attachable. In a sense, this is not unlike one common battery accommodating a variety of construction tools.

This invention can comprise a variety and/or plurality of reservoirs, whilst retaining quick-connecting functionality. For example, the handle (or portion of the handle) (for example in an embodiment wherein it is (and/or used with) a mop (head)) may include upward spraying functionality wherein the upward spray sprays insect repellent, with the handle (or portion) also having downward spray functionality to spray water or cleaning solution to facilitate better cleaning with the mop (and/or to facilitate wet mop usage).

The handle (or portion) may, in an alternate embodiment, facilitate upward spraying, also having downward spray functionality to spray dust adhering spray (which may aid functionality of the mop head), especially for a cotton dust mop.

The handle (or portion) may, in an alternate embodiment, facilitate upward spraying of insect repellent, also having downward spray facility of water to control dust to aid cleaning with a broom head, for example moistening the surface of the ground.

It will be obvious that is it feasible that the handle may have upward spraying functionality, and the head may have downward spraying functionality.

Thus the invention is described in use, in no way limiting a scope of the invention.

Whereas the removable handle (or portion 16' of the handle) has hereinbefore been described with reference to being used as part of (and forming part of) a floor cleaning apparatus, it is feasible, alternately, that the handle (or portion 16'), with any of the aforementioned features described in the present application, may be used (and form part of) a handheld cleaning device, such as, for example, a duster, or window squeegee, which such invention may be claimed. It may be particularly viable and/or usable for such (or any) handheld cleaning device which comprises a pole-shaped (or substantially pole-shaped) handle, (the handle or a portion of the handle being usable for spraying as hereinbefore described). Such handheld cleaning devices tend to have a cleaning element at an end of a (preferably pole-shaped) handle. Thus a duster, for example, comprises a duster cleaning element; a squeegee comprises a squeegee element.

Furthermore, in a broader context, not limited to floor cleaning apparatuses or handheld cleaning devices, the aforedescribed removable handle (or portion of the handle) spraying device may be used as part of any cleaning device under the Sun, and may be claimed in and of its own right as an invention. Furthermore, the removable handle (or portion of the handle) spraying device (which may include any the optional and/or preferable features afforded to the removable handle (or portion) in the present application), may be claimed forming part of any apparatus under the Sun (not limited to cleaning), and may be claimed in and of its own right, irrespective of whether it is attachable to any element and/or forms part of any apparatus.

The embodiments described above are provided by way of examples only, and various modifications may be apparent to those with skill in the art, without departing from the scope of the invention as defined by the appended claims.

What is claimed is:

1. A floor cleaning apparatus, comprising:

a head, the head having a downward facing cleaning element for downward facing cleaning of a floor surface; and a handle for holding, said handle having an axis;

wherein a portion or a whole of the handle is removably attachable from the head and comprises a spraying system, the spraying system itself comprising a plurality of reservoirs and at least one first spray outlet associated with a first of the plurality of reservoirs and directed upwardly and at least one second spray outlet associated with a second of said reservoirs and directed downwardly, wherein spray is sprayable from the at least one first spray outlet upwardly at an angle of less than 90 degrees with regard to the axis of the handle;

the spraying system operable in a first or a second mode, the portion or a whole of the handle attached to the head in the first mode; and the portion or a whole of the handle removed from the head in the second mode.

2. A floor cleaning apparatus as claimed in claim 1, wherein the portion or a whole of the handle is a whole of the handle.

3. A floor cleaning apparatus as claimed in claim 1, wherein the portion or a whole of the handle is a portion of the handle.

4. A floor cleaning apparatus as claimed in claim 3, wherein the portion is directly removably attachable from the head.

5. A floor cleaning apparatus as claimed in claim 3, wherein the portion is indirectly removably attachable from the head, the portion being removably attachable from the handle and not directly connected to the head in the first mode.

6. A floor cleaning apparatus as claimed in claim 1, wherein the spray is sprayable from the at least one first spray outlet upwardly at an angle of 90 degrees or less with respect to an axis of the handle.

7. A floor cleaning apparatus as claimed in claim 1, wherein the apparatus comprises a quick release system for releasing the portion or a whole of the handle from the head.

8. A floor cleaning apparatus as claimed in claim 7, wherein the apparatus comprises user means for quick release of the portion or a whole of the handle.

9. A floor cleaning apparatus as claimed in claim 8, wherein the user means comprises a foot release element about the head or a neck area of the apparatus.

10. A floor cleaning apparatus as claimed in claim 9, wherein the foot release element comprises a protruding flange that can engaged by a foot of a user for quick release of the portion or the whole of the handle.

11. A floor cleaning apparatus as claimed in claim 9, wherein the foot release element comprises a pressurable portion on the head of the apparatus.

12. A floor cleaning apparatus as claimed in claim 8, wherein the user means is provided toward a top of the portion or a whole of the handle.

13. A floor cleaning apparatus as claimed in claim 1, wherein the spraying system further comprises a user selector means, usable by a user to initiate spraying from the and at least one first spray outlet or the at least one second spray outlet.

14. A floor cleaning apparatus as claimed in claim 1, wherein direction of spraying is alterable by a user.

15. A floor cleaning apparatus as claimed in claim 1, wherein at least one of the plurality of reservoirs is removable; or removable and replaceable, functioning as a cartridge.

16. A floor cleaning apparatus as claimed in claim 1, wherein the handle is universally attachable to a plurality of different heads, there being provided a universal attachment system.

* * * * *